US007891897B2

(12) United States Patent
Nanos et al.

(10) Patent No.: US 7,891,897 B2
(45) Date of Patent: Feb. 22, 2011

(54) TRAVEL MULTIPLIER MECHANISMS FOR WRITING INSTRUMENTS

(75) Inventors: Nicholas M. Nanos, Lake in the Hills, IL (US); Andrew Bielecki, Evanston, IL (US); Neville Andrews, West Sussex (GB); Gennady Plavnik, Indian Creek, IL (US)

(73) Assignee: Sanford, L.P., Oak Brook, IL (US)

( * ) Notice: Subject to any disclaimer, the term of this patent is extended or adjusted under 35 U.S.C. 154(b) by 1040 days.

(21) Appl. No.: 11/346,137

(22) Filed: Feb. 2, 2006

(65) Prior Publication Data

US 2007/0020023 A1 Jan. 25, 2007

Related U.S. Application Data

(60) Provisional application No. 60/649,734, filed on Feb. 3, 2005.

(51) Int. Cl.
*B43K 5/16* (2006.01)

(52) U.S. Cl. ..... 401/112; 401/110; 401/111

(58) Field of Classification Search ..... 401/82, 401/99, 104–106, 109–112
See application file for complete search history.

(56) References Cited

U.S. PATENT DOCUMENTS

| | | | | |
|---|---|---|---|---|
| 2,518,429 | A | 8/1950 | Moorhead | |
| 2,988,055 | A * | 6/1961 | Platt | 401/106 |
| 3,084,671 | A | 4/1963 | Dottlinger | |
| 3,315,643 | A | 4/1967 | Eratico | |
| 3,544,227 | A | 12/1970 | Green | |
| 3,558,233 | A * | 1/1971 | Zepell | 401/106 |
| 3,792,931 | A | 2/1974 | Ganz | |
| 3,916,701 | A | 11/1975 | Butler | |
| 4,221,490 | A | 9/1980 | Malm | |
| 4,533,271 | A | 8/1985 | Sansevero | |
| 4,580,918 | A | 4/1986 | Baker et al. | |
| 4,948,285 | A | 8/1990 | Schleif | |
| 4,991,988 | A | 2/1991 | Snell et al. | |
| 5,004,364 | A | 4/1991 | Tomura et al. | |
| 5,022,772 | A | 6/1991 | Kageyama et al. | |

(Continued)

FOREIGN PATENT DOCUMENTS

| | | |
|---|---|---|
| DE | 1943308 | 3/1971 |

(Continued)

OTHER PUBLICATIONS

English Abstract of JP 01-234299, Sep. 19, 1989.*

(Continued)

*Primary Examiner*—David J Walczak
(74) *Attorney, Agent, or Firm*—Marshall, Gerstein & Borun LLP

(57) ABSTRACT

A writing instrument includes a travel multiplier mechanism that includes a cam member that pivots about a pivot axis in response to motion of a push button member. The cam member engages a sliding piston member in order to provide a travel multiplying effect such that a distance of travel of the sliding piston member exceeds a distance traveled by the push button member. The cam member may be configured to rotate about an axis that is located in a plane perpendicular to a primary axis of a barrel of the writing instrument.

16 Claims, 14 Drawing Sheets

U.S. PATENT DOCUMENTS

| | | | | |
|---|---|---|---|---|
| 5,026,190 | A | 6/1991 | Longarzo | |
| 5,810,496 | A * | 9/1998 | Kageyama et al. | 401/65 |
| 5,918,993 | A | 7/1999 | Koyama | |
| 6,273,627 | B1 | 8/2001 | Mittersinker et al. | |
| 6,758,617 | B2 * | 7/2004 | Sakaoka | 401/92 |
| 6,761,231 | B1 | 7/2004 | Dock et al. | |
| 7,066,042 | B2 * | 6/2006 | Andrews et al. | 74/110 |
| 7,086,797 | B1 * | 8/2006 | Huang | 401/195 |
| 2005/0147456 | A1 | 7/2005 | Andrews et al. | |

FOREIGN PATENT DOCUMENTS

| | | | |
|---|---|---|---|
| DE | 199 56 773 A1 | | 6/2001 |
| DE | 10018461 | | 10/2001 |
| GB | 1248379 | | 9/1971 |
| JP | 01-234299 | * | 9/1989 |

OTHER PUBLICATIONS

Written Opinion for International Patent Application No. PCT/US2004/043992, dated Aug. 1, 2005, 5 pages.

International Search Report for International Patent Application No. PCT/US2004/043992, dated Aug. 1, 2005, 7 pages.

*International Search Report* corresponding to co-pending International Patent Application Serial No. PCT/US2006/004075 dated Sep. 29, 2006, 4 pages.

*Written Opinion of the International Searching Authority* corresponding to co-pending International Patent Application Serial No. PCT/US2006/004075, dated Sep. 29, 2006, 7 pages.

* cited by examiner

TRAVEL MULTIPLIER MECHANISMS FOR WRITING INSTRUMENTS

CROSS-REFERENCE TO RELATED APPLICATIONS

This application claims the benefit under 35 U.S.C. §119 (e) of U.S. provisional patent application Ser. No. 60/649,734 filed Feb. 3, 2005, the entire disclosure of which is incorporated herein by reference.

TECHNICAL FIELD

The disclosure is related generally to writing instruments, and more particularly to writing instruments having retractable writing tips.

BACKGROUND OF THE DISCLOSURE

Writing instruments have been developed that are capable of being put in either a retracted or an extended configuration, as desired by the user.

A typical writing instrument of such type may include a barrel with a clip, an ink cartridge arranged within the barrel and having a writing tip, a push button, and a mechanism providing extending and retracting movement of the ink cartridge out of the barrel, and maintaining the ink cartridge in a writing position. The mechanism may include a push button, a ratchet, and a return spring.

However, for certain writing instruments, such as, for example, fountain pens, highlighters or other types of markers having felt tips, moving a writing tip from an extended position to a retracted position and vice versa may require a large amount of travel, making a mechanism for extending and retracting the writing tip cumbersome, difficult to use, and bulky.

The present disclosure is directed to solving one or more of the problems associated with the prior art.

SUMMARY OF THE DISCLOSURE

In accordance with one aspect of the disclosure, a writing instrument includes a travel multiplier mechanism that includes a cam member that pivots about a pivot axis in response to motion of a push button member. The cam member engages a sliding piston member in order to provide a travel multiplying effect such that a distance of travel of the sliding piston member exceeds a distance traveled by the push button member.

DETAILED DESCRIPTION

Figure 1:
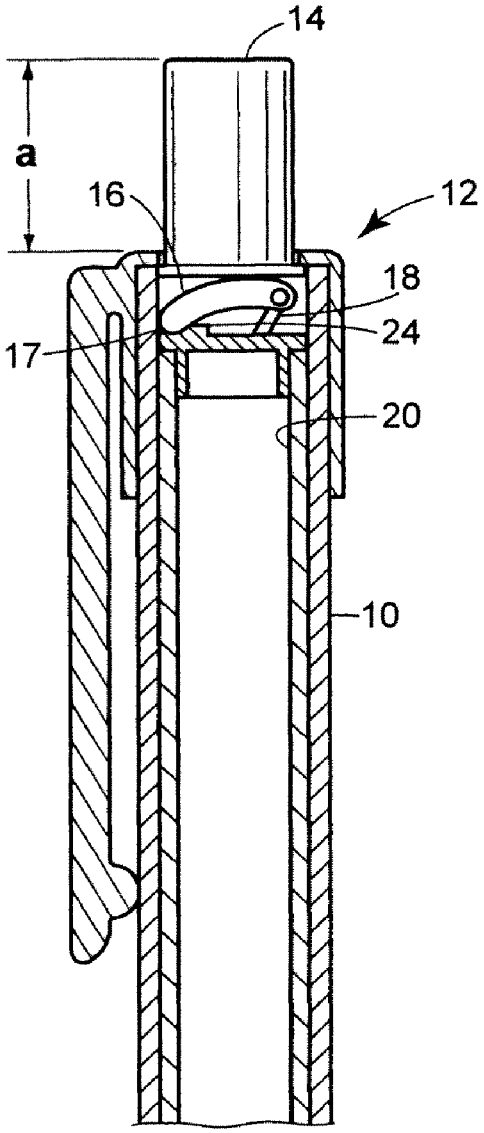
FIG. 1 is a schematic partial cross-sectional view of a writing instrument according to a first embodiment of the disclosure, in a retracted configuration.

With reference initially to FIG. 1, a first embodiment of the disclosure includes a writing instrument 10 having a travel multiplier mechanism, generally indicated at 12. The travel multiplier mechanism 12 includes a push button member 14, that abuts a sliding and rotating cam member 16 that is pivotally engaged within opposing slots 18 formed in a wall 20 of the writing instrument 10. The sliding and rotating cam member 16 also includes a tip 17 that abuts a sliding piston member 22 that is disposed within the wall 20. The sliding piston member 22 may include a protuberance 24 that, along with the wall 20 and the slots 18, serves to constrain the motion of the sliding and rotating cam member 16 as the push button member 14 is moved from an extended position, as shown in FIG. 1, to a retracted position, as shown in FIG. 2.

Figure 2:
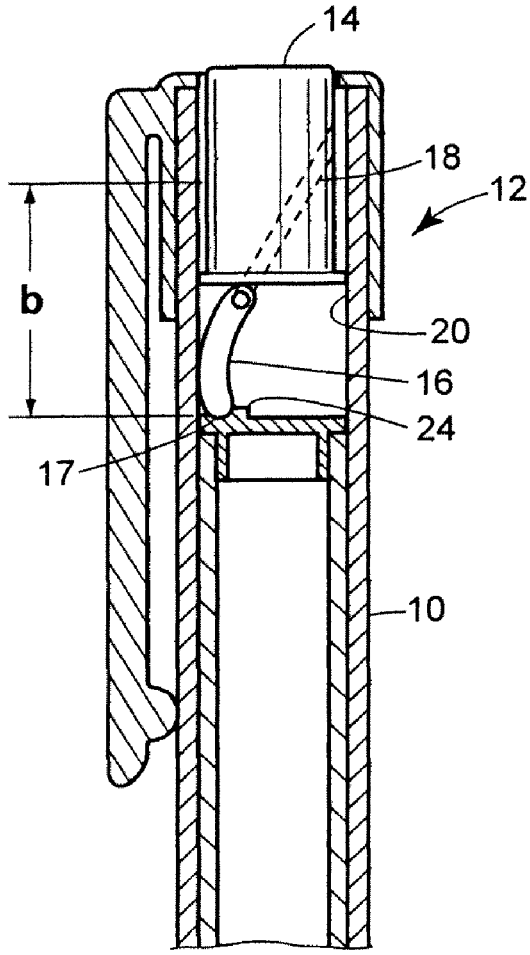
FIG. 2 is a schematic partial cross-sectional view of the writing instrument of FIG. 1, in an extended configuration.

As can be seen by an examination of FIGS. 1 and 2, the slots 18 may be disposed at a diagonal orientation so that the sliding and rotating cam member 16 moves from a substantially horizontal orientation when the push button member 14 is in the extended position, as shown in FIG. 1, to a substantially vertical orientation when the push button member 14 is in the retracted position, having moved a distance of travel, a, as shown in FIG. 2. This rotation of the sliding and rotating cam member 16, as well as the translation thereof in a generally vertical direction as oriented in FIG. 2, serves to provide a distance of travel, b, of the tip 17 of the sliding and rotating cam member 16 and of the sliding piston member 22 that exceeds the distance of travel, a, of the push button member 14 between the retracted position and the extended position.

As will be recognized by those of skill in the art, the additional distance of travel of the tip 17 of the sliding and rotating cam member 16 as compared to the distance of travel of the push button member 14 is advantageous for any writing instrument or other apparatus that requires an extension/retraction mechanism providing a large travel distance of a component such as a writing instrument tip, while minimizing the travel distance of an actuating mechanism such as a push button member, while minimizing the amount of space required for such an apparatus. For example, it is envisioned that the travel multiplication mechanism shown in FIGS. 1 and 2 would be especially useful for a retractable felt-tip marker that requires a large amount of travel to expose the tip of the marker, without requiring a very long, cumbersome, and unattractive push button member.

Figure 3:
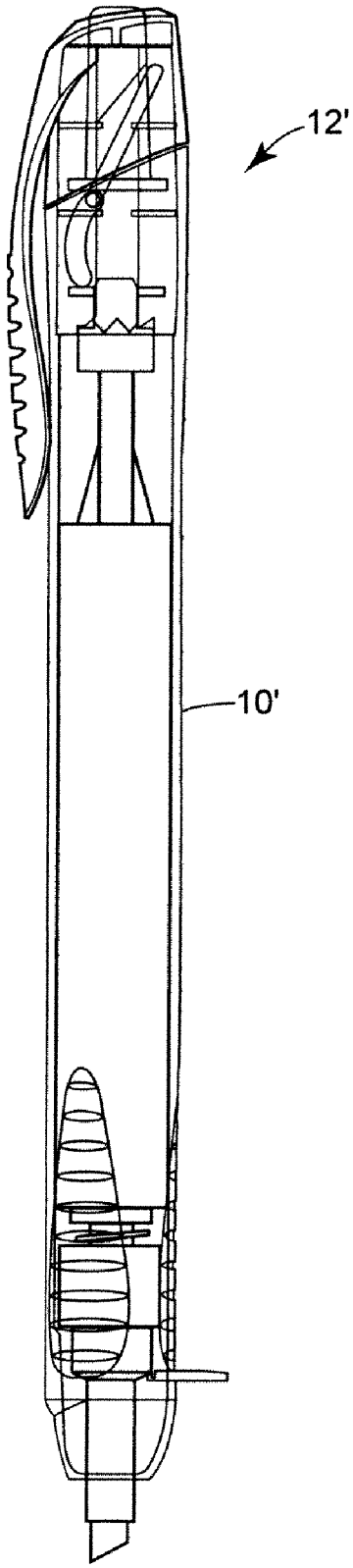
FIG. 3 is a side view of a writing instrument according to a second embodiment of the disclosure.
Figure 4:
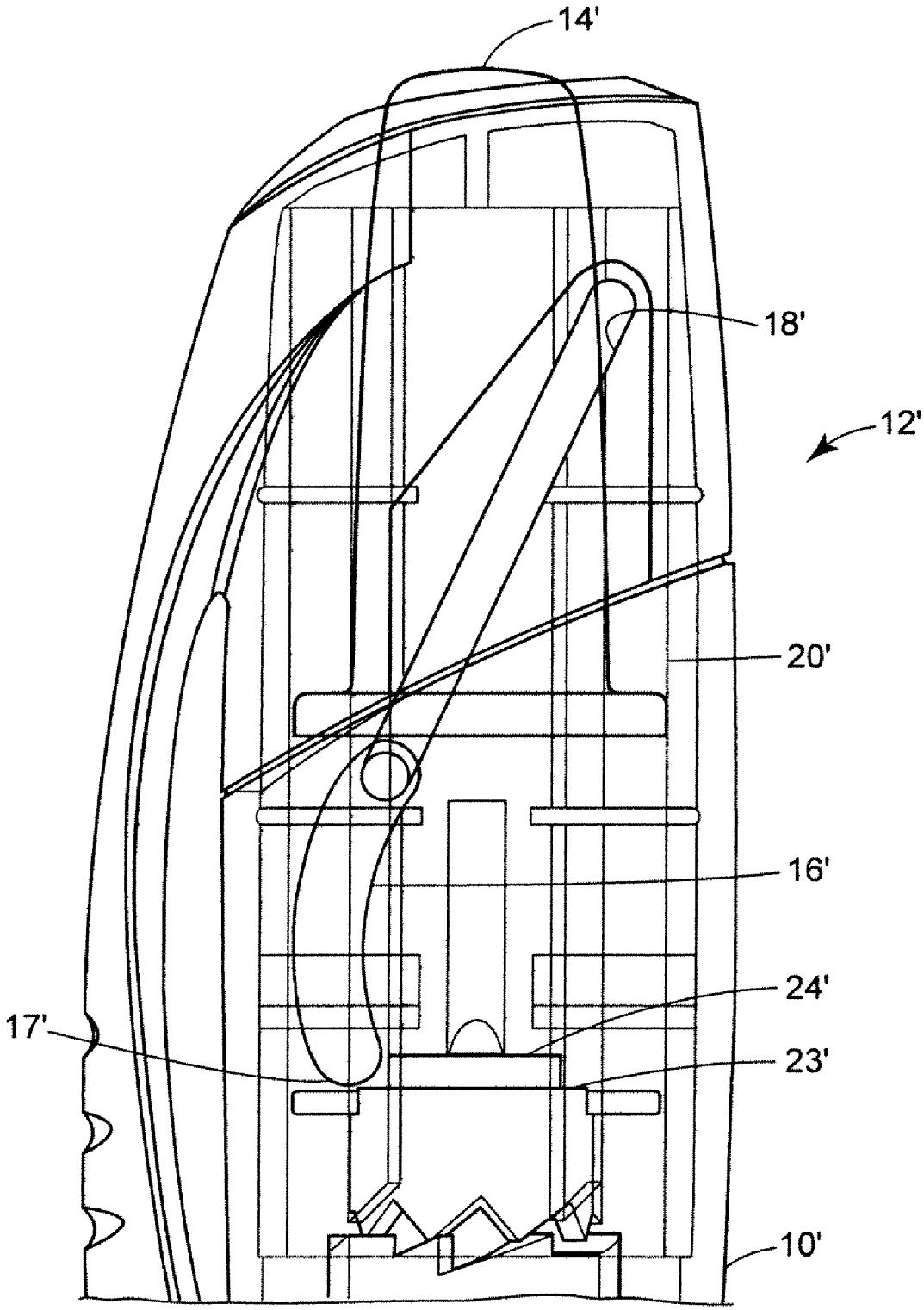
FIG. 4 is an enlarged side view of an upper portion of the writing instrument of FIG. 3.

FIG. 3 is a side view of another embodiment of a writing instrument 10' having a mechanism similar to that of the writing instrument 10 depicted in FIGS. 1 and 2. As shown in FIG. 4, the writing instrument 10' includes a travel multiplier mechanism, generally indicated at 12'. The travel multiplier mechanism 12' includes a push button 14', that abuts a sliding and rotating cam member 16' that is pivotally engaged within opposing slots 18' formed in a wall 20' of the writing instrument 10'. The sliding and rotating cam member 16' also includes a tip 17' that abuts a ratchet member 23' that is disposed within the wall 20'. The ratchet member 23' includes a cylindrical protuberance 24' that, along with the wall 20' and the slots 18', serves to constrain the motion of the sliding and rotating cam members 16' as the push button member 14' is moved from an extended position to a retracted position. A pair of flanges 25A' and 25B' are provided on the ratchet member 23', and engage vertical slots 27A' and 27B' formed in the wall 20 to prevent rotation of the ratchet member 23'.

Figure 5:
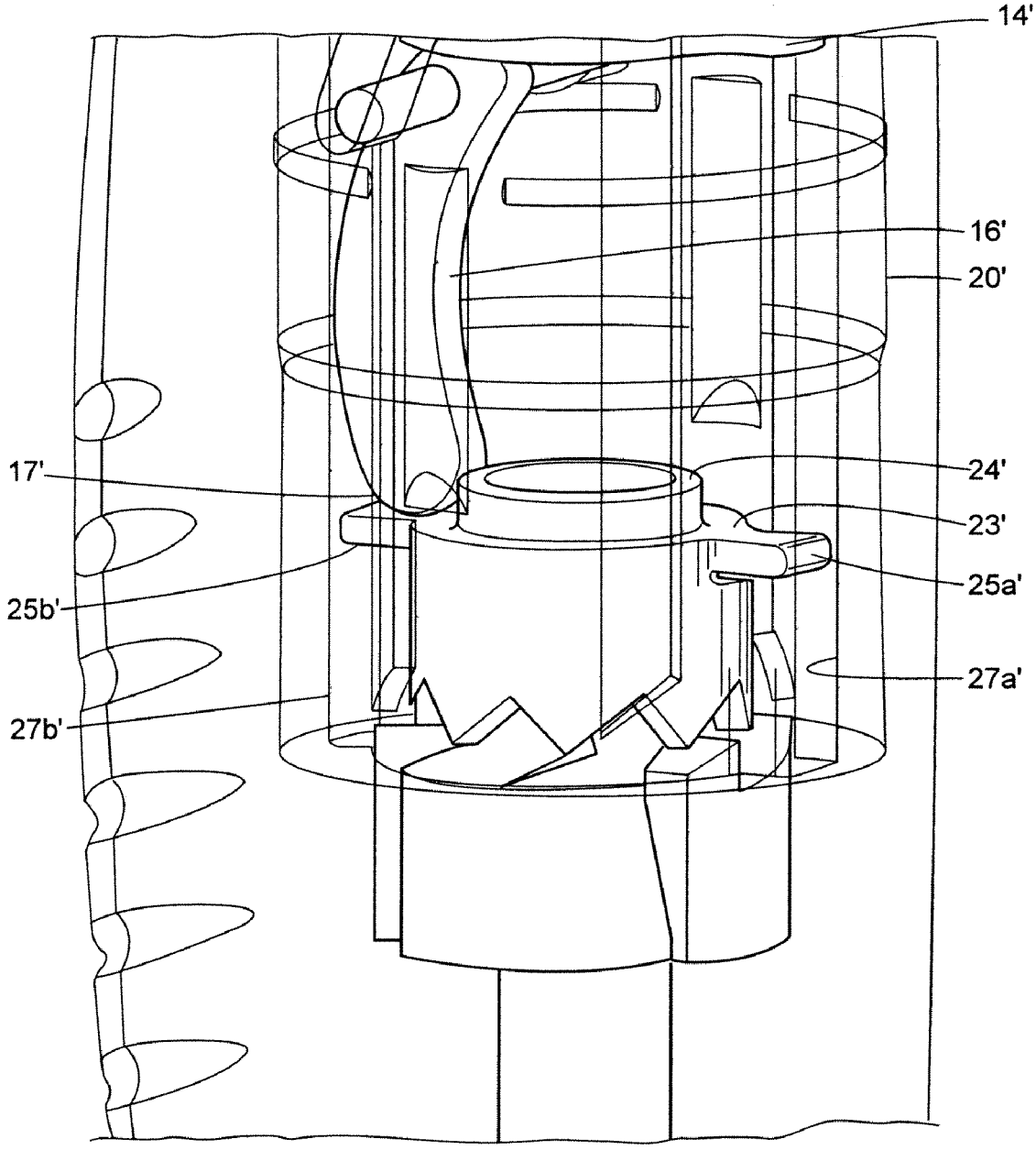
FIG. 5 is an enlarged perspective view of a portion of a travel multiplier mechanism forming part of the writing instrument of FIG. 3.

The slots 18' may be disposed at a diagonal orientation so that the sliding and rotating cam member 16' moves from a substantially horizontal orientation when the push button member 14' is in the extended position, to a substantially vertical orientation when the push button member 14' is in the retracted position. As was the case with the embodiment of FIGS. 1 and 2, the rotation of the sliding and rotating cam member 16', as well as the translation thereof in a generally vertical direction as oriented in FIGS. 3-5 serves to provide a distance of travel of the tip 17' of the sliding and rotating cam member 16' and of the ratchet member 23' that exceeds the distance of travel of the push button member 14' between the retracted position and the extended position.

Again, the additional distance of travel of the tip 17' of the sliding and rotating cam member 16' as compared to the distance of travel of the push button member 14' is advantageous for any writing instrument or other apparatus that requires an extension/retraction mechanism providing a large distance of travel of a component such as a writing instrument, while minimizing the travel distance of an actuating mechanism such as a push button member, and while minimizing the amount of space required for such an apparatus.

Figure 6:
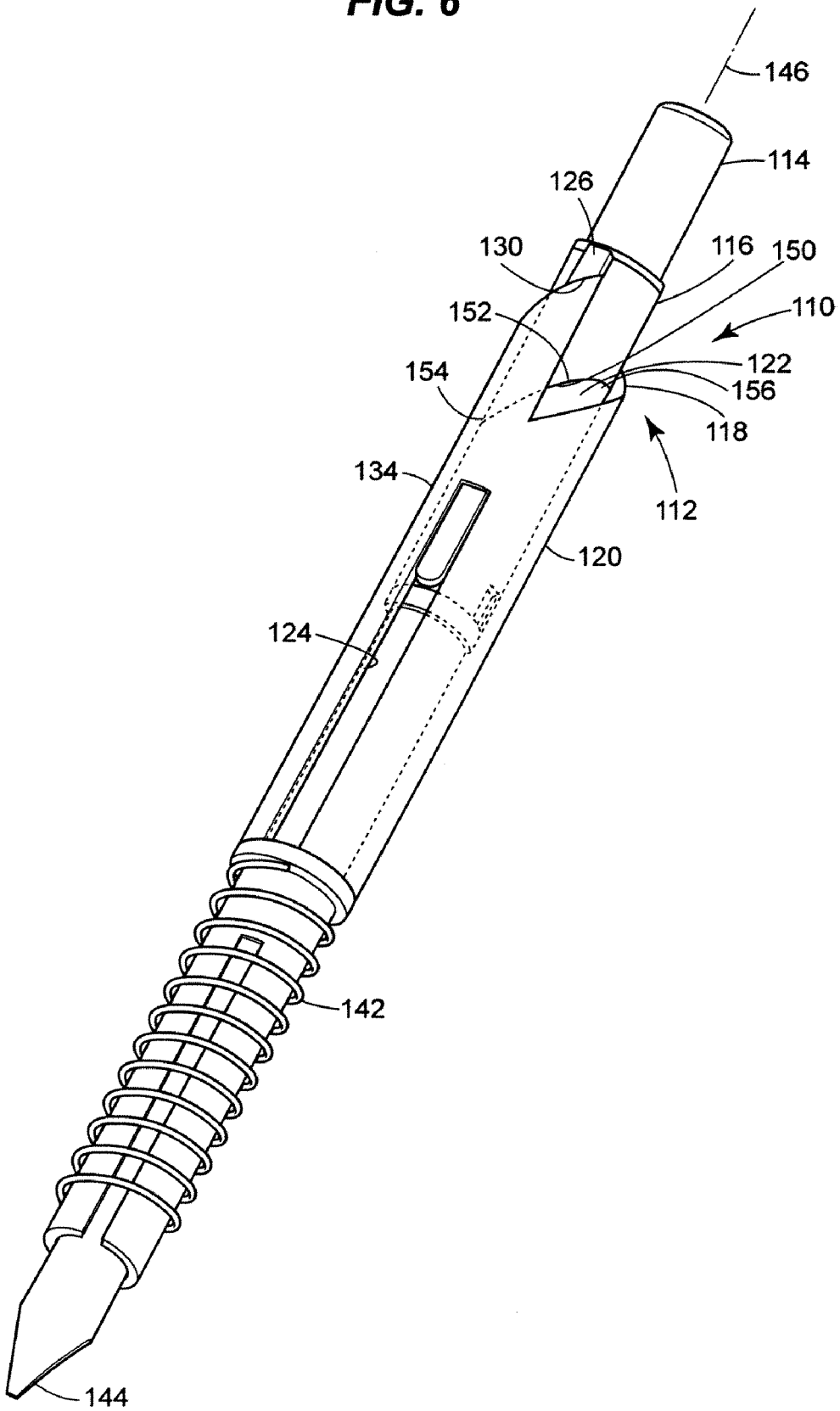
FIG. 6 is a cutaway perspective view of a third embodiment of a writing instrument according to the disclosure in a retracted configuration.
Figure 7:
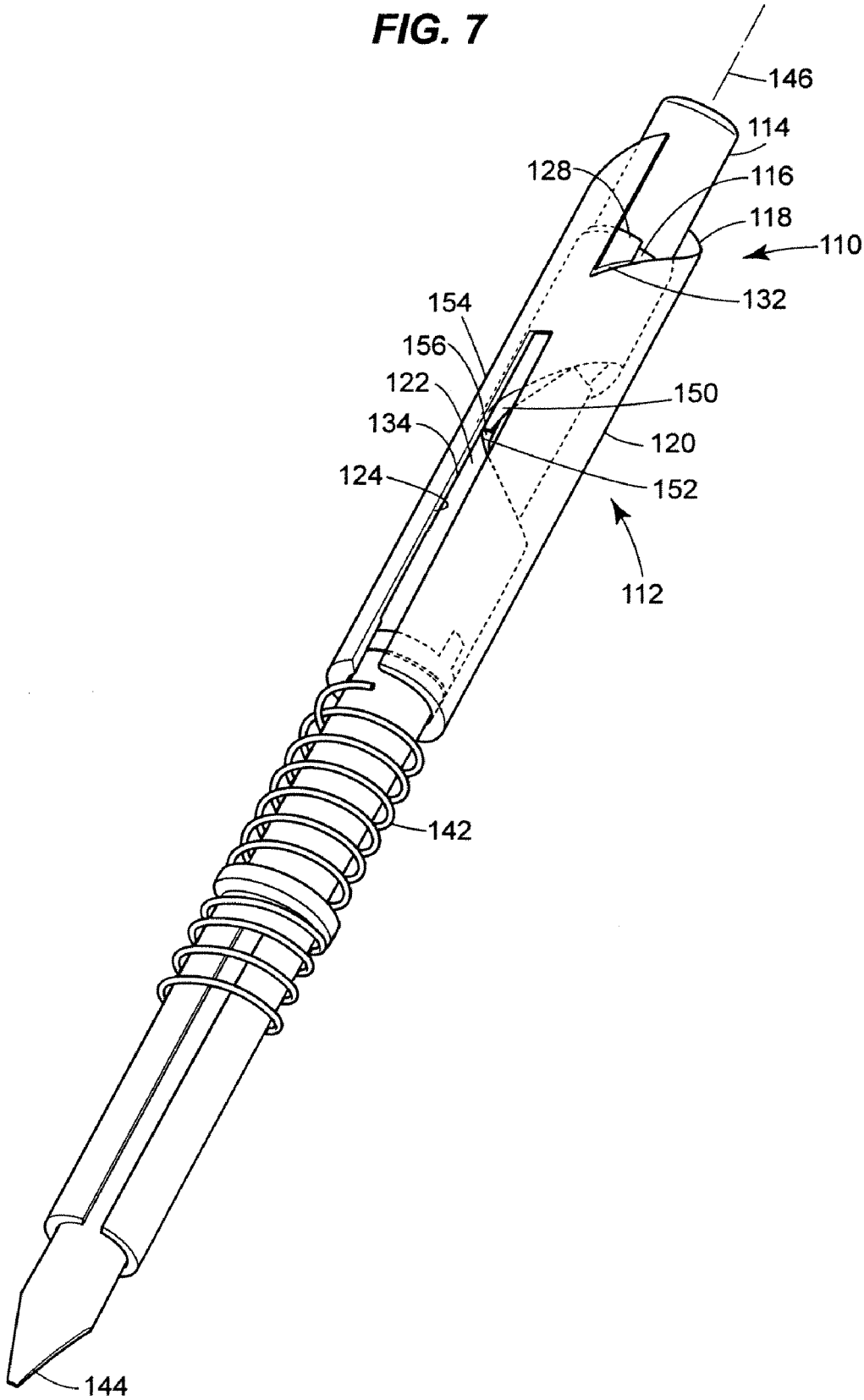
FIG. 7 is a cutaway perspective view of the writing instrument of FIG. 6 in an extended configuration.
Figure 8:
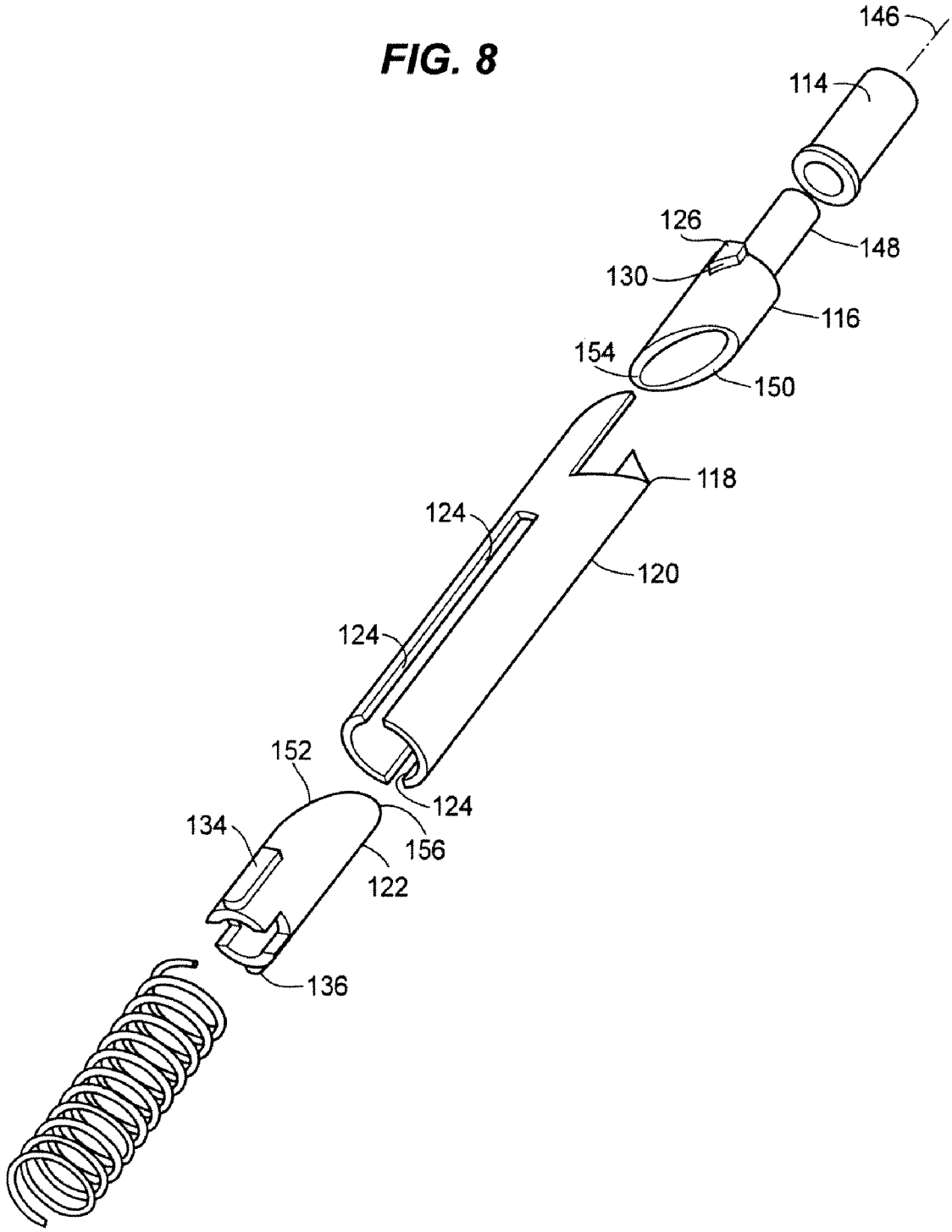
FIG. 8 is an exploded view of components of the writing instrument of FIG. 6.

With reference now to FIGS. 6-8 a further embodiment is provided, in the form of a writing instrument 110 that includes a travel multiplier mechanism, generally indicated at 112. The travel multiplier mechanism 112 includes a push button 114, that abuts a first sliding cam member 116 that in turn engages a helical slot 118 of an inner barrel 120 of the writing instrument 110. (The writing instrument 110 may include an outer barrel, not shown in FIGS. 6-8 for clarity.) A second sliding cam member 122 engages a pair of straight slots 124 formed in opposing sides of the inner barrel 120. The first sliding cam member 116 may include first and second protuberances 126, 128, that may be disposed on opposite sides of the first sliding cam member 116. The first and second protuberances 126 and 128 may each include an angled surface 130, 132, respectively, that matches the contour of the helical slot 118 when the first sliding cam member 116 is disposed partially within the inner barrel 120. Similarly, the second sliding cam member 122 may include first and second straight protuberances 134, 136, that engage the straight slots 124 formed in the inner barrel 120 when the second sliding cam member 122 is disposed within the inner barrel 120.

The first sliding cam member 116 and the second sliding cam member 122 may each have opposed angled faces, 138, 140.

A spring 142 may be provided to urge the second sliding cam member 122, the first sliding cam member 116, and the push button 114 toward a position in which the push button 114 is extended, thereby placing a writing tip 144 in a retracted position within an outer barrel (not shown in FIGS. 6-8).

In operation, as the push button 114 is pressed to place the push button 114 in a retracted position, and in turn place the writing tip 144 in an extended position, the first sliding cam member 116, as it is pushed by the push button 114, will translate in a direction along a primary axis 146 of the writing instrument 110, and will also rotate about the primary axis 146, due to the interaction of the angled surfaces 130 and 132 with the helical slot 118. The rotation and translation of the first sliding cam member 116 causes the second sliding cam member 122 to translate (as the second sliding cam member 122 is constrained from rotation by the engagement of the first and second straight protuberances 134 and 136 with the straight slots 124) over a distance that exceeds the distance of translation of the push button 114 and the first sliding cam member 116.

The push button 114 may be formed such that it fits over a round cylindrical protrusion 148 of the first sliding cam member 116 (shown in FIG. 8), such that the push button 114 and the first sliding cam member 116 are free to rotate with respect to one another about the primary axis 146. When the writing tip 144 is in the retracted position, as shown in FIG. 6, angled contact surfaces 150 and 152 of the first sliding cam member 116 and the second sliding cam member 122, respectively, are in position such that the angled contact surfaces 150 and 152 are in substantially complete overlapping contact with one another and are substantially parallel to one another. This provides a compact configuration when the writing tip 144 is in the retracted position.

However, when the writing tip 144 is in the extended position, as shown in FIG. 7, the angled contact surfaces 150 and 152 contact one another at outermost apex regions 154 and 156 of the angled surfaces 150 and 152, respectively, thereby providing a maximum extended position of the writing tip 144.

Figure 9:
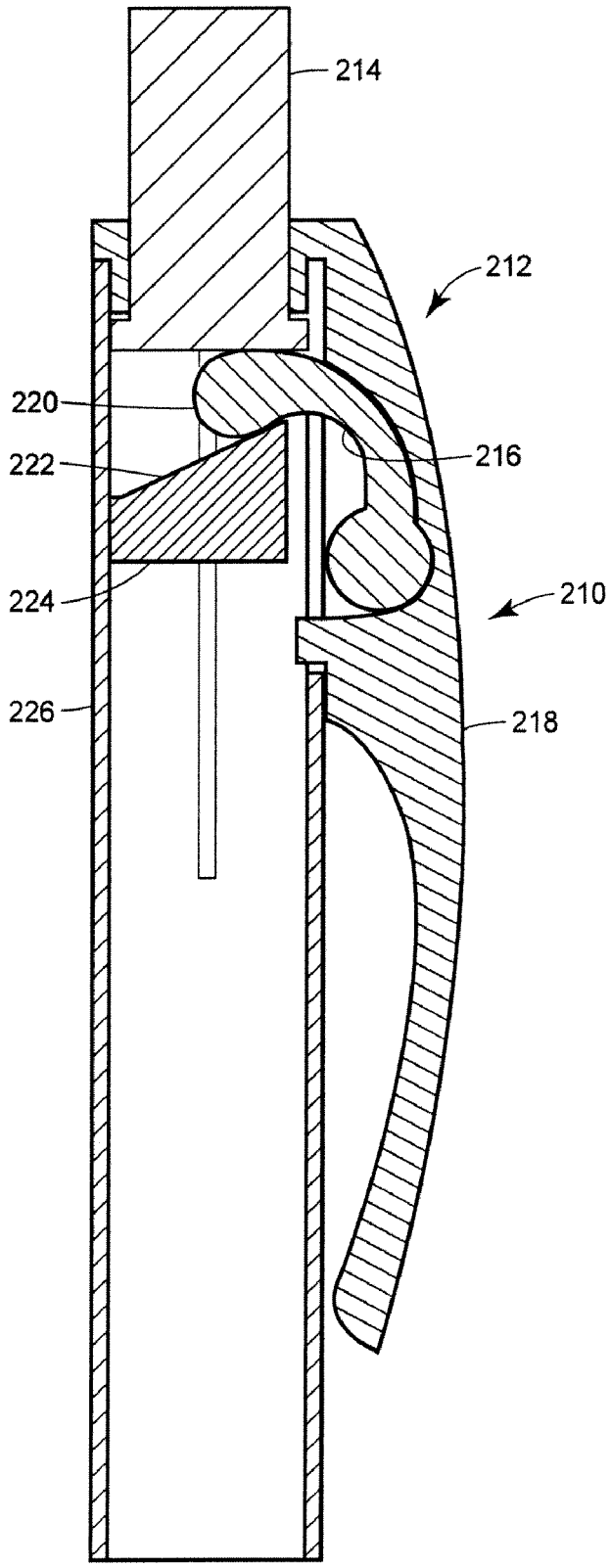
FIG. 9 is a partial cross-sectional view of an upper portion of a fourth embodiment of a writing instrument according to the disclosure in a retracted configuration.
Figure 10:
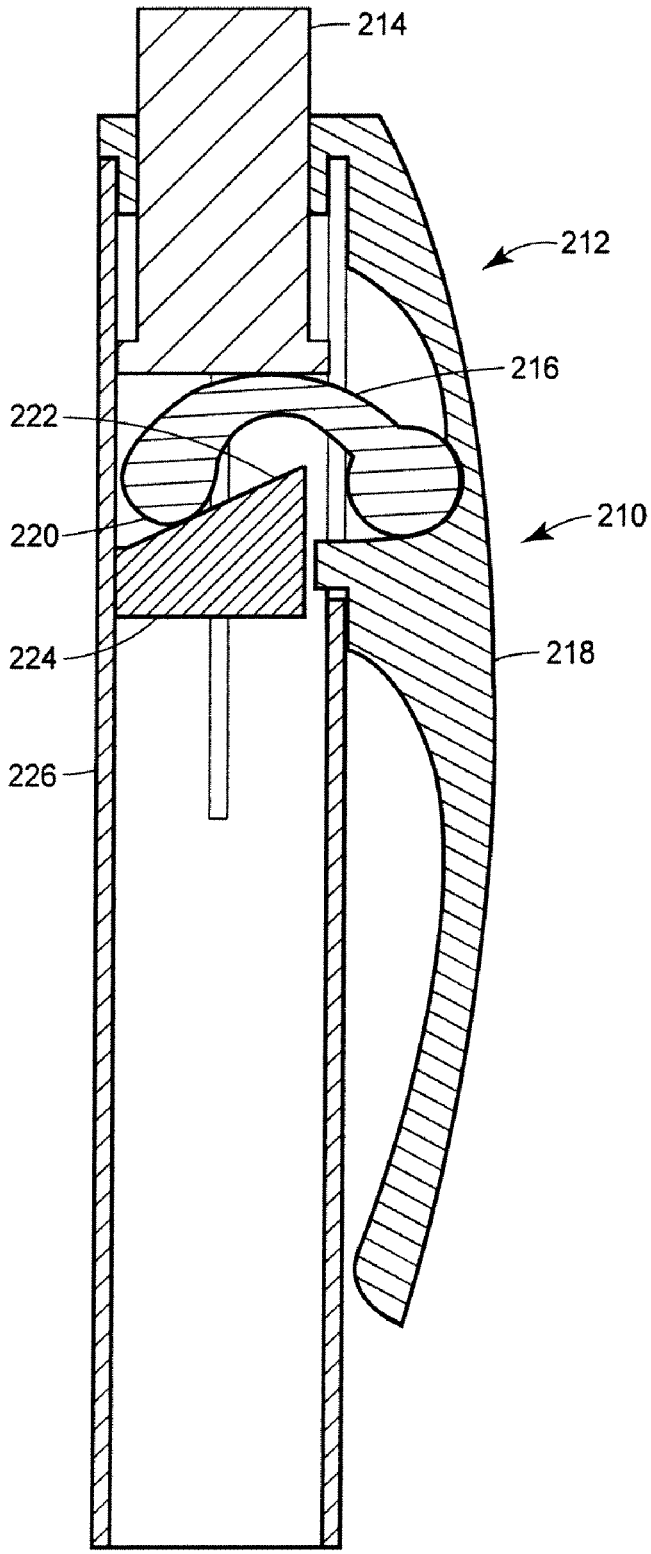
FIG. 10 is a partial cross-sectional view of the upper portion of the writing instrument of FIG. 9 in a partially extended configuration.
Figure 11:
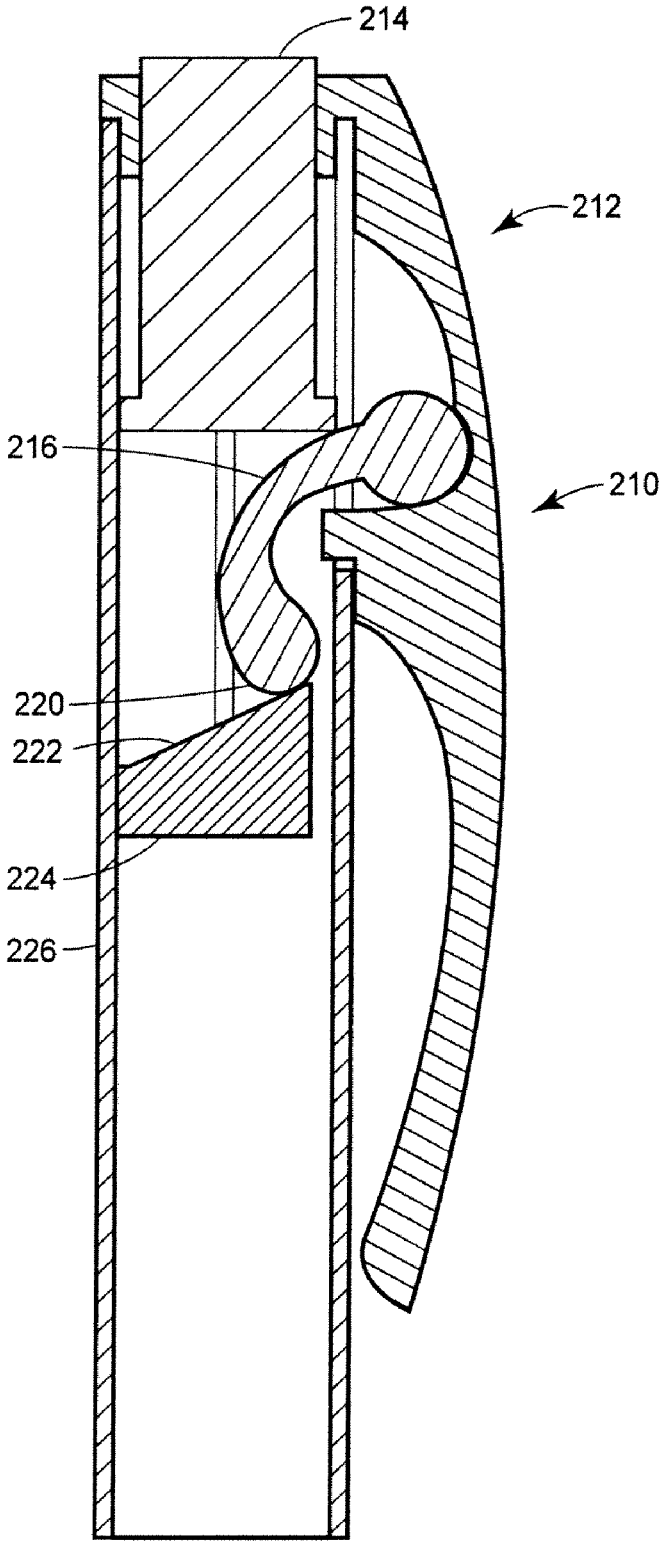
FIG. 11 is a partial cross-sectional view of the upper portion of the writing instrument of FIG. 9 in a fully extended configuration.

With reference now to FIGS. 9-11, another embodiment is shown, in the form of a writing instrument 210 that includes a travel multiplier mechanism, generally shown at 212. The travel multiplier mechanism 212 includes a push button 214 that abuts a rotating cam member 216 that may be pivotally secured to a clip member 218 of the writing instrument 210. An end portion 220 of the rotating cam member 216 engages an angled surface 222 of a sliding piston member 224 that is disposed within a barrel 226 of the writing instrument 210.

FIG. 10 is a schematic diagram showing the respective positions of the push button member 214, the rotating cam member 216, and the sliding piston member 224 in an intermediate position when the push button member 214 is between the extended position shown in FIG. 9 and the retracted position shown in FIG. 11.

Yet another embodiment of the writing instrument 210 is shown in FIGS. 12-18. The rotating cam member 216 is installed with possibility of rotation about an axis 246 (FIG. 18) located in a plane perpendicular to a primary axis 228 (FIG. 12) of the barrel. As shown in FIGS. 14-18 the rotating cam marker 216 may be disposed between the push button 214 and a ratchet system 230, and may have profiled surface that contacts respectively with a lower surface of the push button 214 and an upper ratchet member 236, so that the push button and the upper ratchet member 236 form driving and receiving components of the travel multiplier mechanism 212, respectively.

Figure 12:
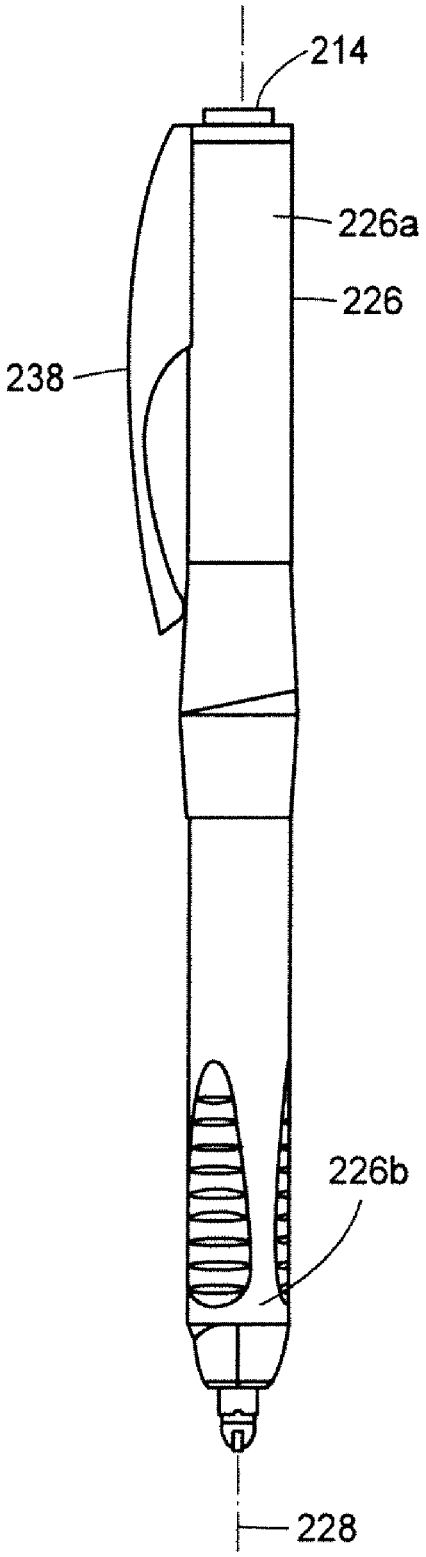
FIG. 12 is a side view of a writing instrument according to a fifth embodiment of the disclosure.
Figure 13:
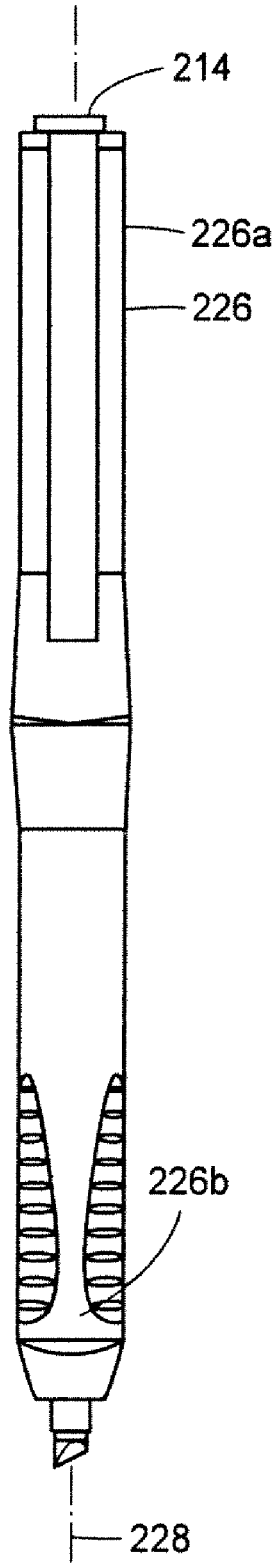
FIG. 13 is a front view of the writing instrument of FIG. 12.
Figure 14:
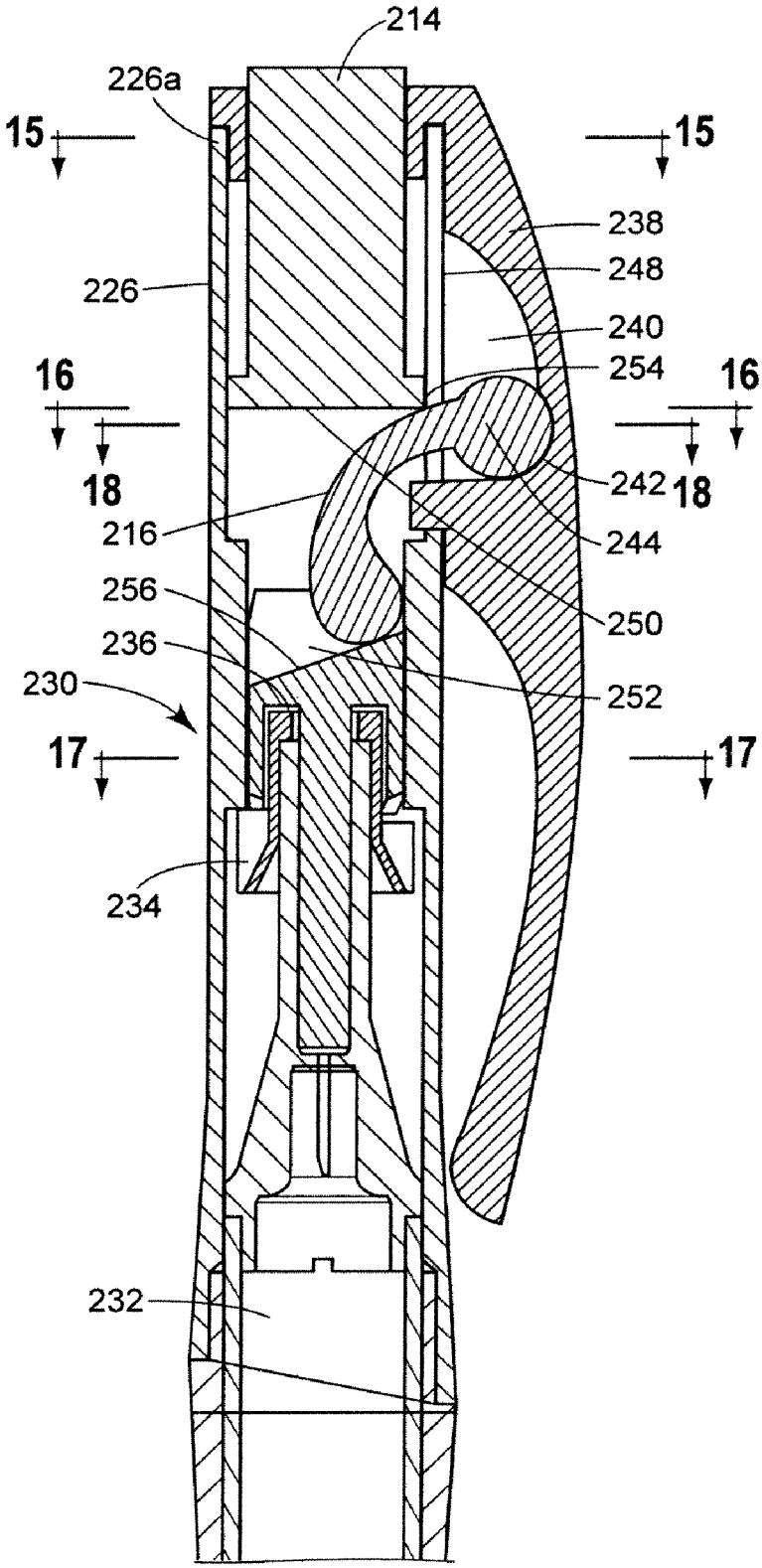
FIG. 14 is a partial cross-sectional view of an upper portion of the writing instrument of FIG. 12, taken along lines 14-14 of FIG. 13.
Figure 15:
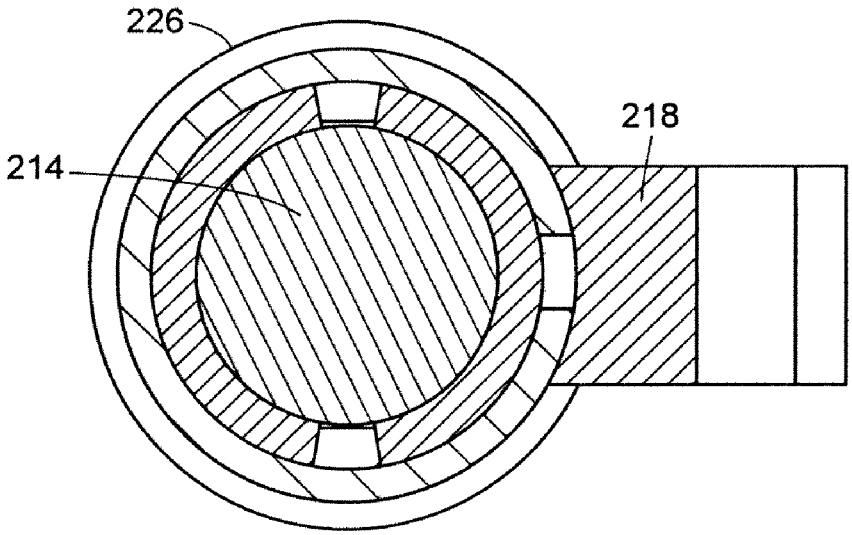
FIG. 15 is a cross-sectional view of the writing instrument of FIG. 12, taken along lines 15-15 of FIG. 14.
Figure 16:
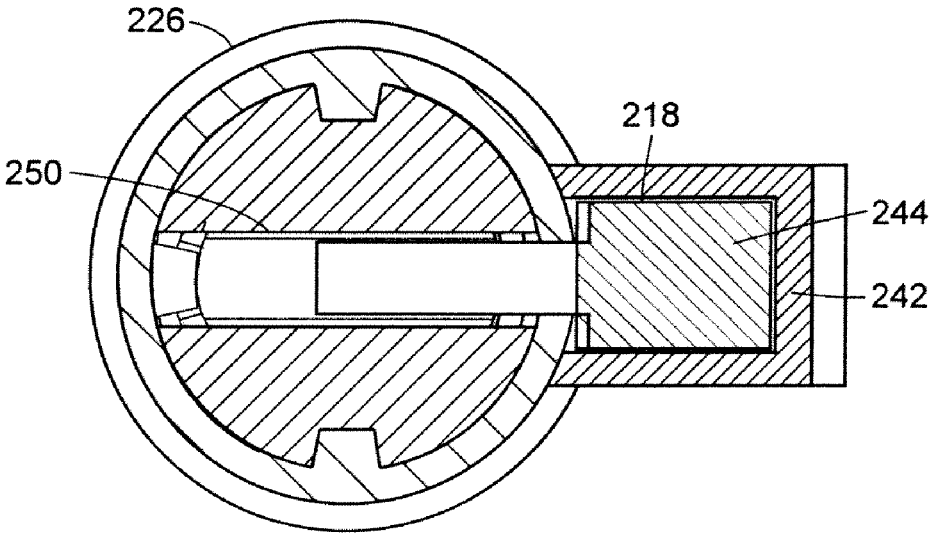
FIG. 16 is a cross-sectional view of the writing instrument of FIG. 12, taken along lines 16-16 of FIG. 14.
Figure 17:
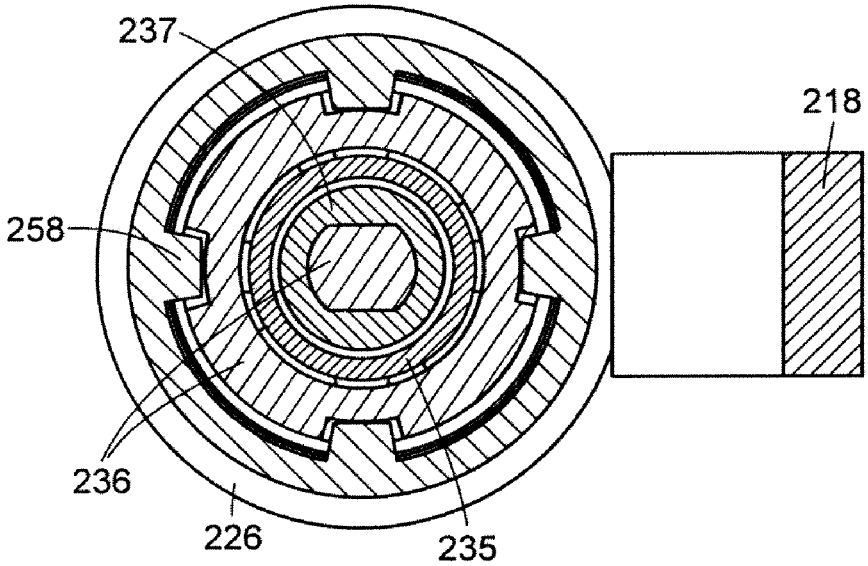
FIG. 17 is a cross-sectional view of the writing instrument of FIG. 12, taken along lines 17-17 of FIG. 14.
Figure 18:
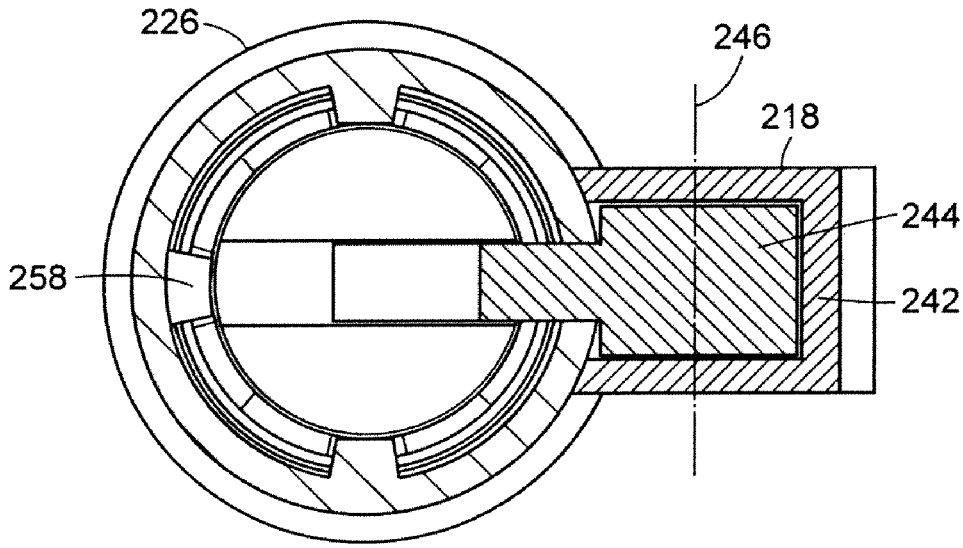
FIG. 18 is a cross-sectional view of the writing instrument of FIG. 12, taken along lines 18-18 of FIG. 14.

The barrel 226 may include upper and lower parts 226*a*, 226*b* (FIGS. 12 and 13). The push button 214 may be installed inside of the upper part 226*a* of the barrel 226 with possibility of linear movement along the primary axis 228 of the barrel 226. A replaceable ink cartridge 232 may be disposed in the barrel 226 and biased toward the upper part of the barrel 226 by a coiled spring (not shown at the drawing), disposed inside of the lower end barrel 226*b*. The upper end of the ink cartridge 232 may be engaged with a lower ratchet 234, which may engage the upper ratchet 236 maintaining the ink cartridge 232 in an extended writing position at the end of the extending movement, and releasing the ink cartridge 232 at the start of retraction. The lower ratchet 234 may include a sleeve portion 235 and the upper ratchet 236 may include a post portion 237 that engages the sleeve portion 235. A clip 238 may be manufactured as an integrated part of the barrel 226, or as a separate element. The clip 238 may include a cavity 240 with a cylindrical portion 242, which supports a cylindrical part 244 of the rotating cam member 216. The cylindrical part 244 of the rotating cam member 216 may be installed between a side surface of the barrel and inside of the cylindrical portion 242, forming a rotational joint with a fixed axis 246 (FIG. 18) of rotation. A slot 248 formed in the upper part 226*a* of the barrel, provides possibility of rotation of the rotating cam member 216.

The push button 214 and the upper ratchet 236 have slots 250 and 252, respectively, of the same width. The slots 250 and 252 facilitate installation and free rotation of the rotating cam member 216. The rotating cam member 216 may be installed inside of the slots, and inside of the cavity 240 with possibility of rotation around the axis 246 of the cylindrical portion 242 of the cavity 240, so that the profiled surface of the rotating cam member 216 contacts with profiled surfaces 254 and 256, of the push button 214 and the upper ratchet 236, respectively. Protrusions 258 (FIG. 17) may be provided at the inside surface of the upper end 226*a* of the barrel 226 to form a guide system for the linear movement of the ratchets 234 and 235.

When pressed down, the push button 214 transfers force to the surface of the rotating cam member 216 causing the rotation of the rotating cam member 216 around the axis 246 of the cylindrical portion 242 of the cavity 240. Because the rotating cam member 216 is in constant contact with the surface of the upper ratchet 236, rotation of the rotating cam member 216 results in linear movement of the upper ratchet 236. The movement of the upper ratchet 236 through the lower ratchet 234 is transferred to the ink cartridge 6. As a result, because of the cam rotation and its profile, the linear movement of the push button 214 is amplified mechanically.

When the push button 24 is pressed, the movement of the push button 214 down initiates rotation of the rotating cam member 216, which in turn initiates linear movement of the ratchets 234 and 236 and extension of the ink cartridge 232. Upward movement of the ratchets 234 and 236 at the time of the retraction of the ink cartridge 232 initiates rotation of the rotating cam member 216 in the opposite direction and movement of the push button 214 upward. The profile and rotation of the rotating cam member 216 provide transfer of the linear movement from the push button 214 to the upper ratchet 226 with displacement multiplication. The multiplication coefficient (transfer ratio) depends on the location of the cam rotational axis 246 (relatively to the primary axis 228 of the barrel 226), cam radius, and cam profile. In this embodiment shown in FIGS. 12-18, in which a cam rotational axis 246 was located outside of the surface of the barrel 226, the transfer ratio was equal to about 1.9.

Although the preferred embodiments of the invention have been disclosed for illustrative purposes, those skilled in the art will appreciate that various modifications, additions and substitutions are possible, without departing from the scope and spirit of the invention as disclosed herein.

What is claimed is:

1. A writing instrument comprising:

a barrel having a longitudinal length and a central axis extending along the longitudinal length;

a writing tip disposed at a lower portion of the barrel and on the central axis;

a push button member disposed at an upper portion of the barrel that is opposite the lower portion, the central axis passing through the push button member, said push button member being movable along the central axis between an extended position and a retracted position;

a cam member that pivots about a pivot axis from a substantially horizontal orientation to a substantially vertical orientation in response to motion of the push button member from the extended position to the retracted position; and a sliding piston member that is engaged by the cam member, the sliding piston member disposed on the central axis and configured such that a distance of travel of the sliding piston member along the central axis exceeds a distance traveled by the push button member along the central axis when the push button member is moved between the extended position and the retracted position.

2. The writing instrument of claim 1, wherein the pivot axis lies in a plane that is perpendicular to the central axis.

3. The writing instrument of claim 1, wherein the cam member pivots and translates when the push button member is moved between the extended position and the retracted position.

4. The writing instrument of claim 3, wherein the writing instrument includes a wall having opposing slots formed therein, and the cam member is pivotally engaged within the opposing slots.

5. The writing instrument of claim 4, wherein the slots are disposed at a diagonal orientation with respect to the central axis.

6. The writing instrument of claim 1, wherein the sliding piston member is directly engaged by the cam member.

7. The writing instrument of claim 1, wherein the pivot axis of the cam member translates from a first position to a second position along the central axis of the writing instrument in response to motion of the push button member from the extended position to the retracted position.

8. A travel multiplier mechanism for a writing instrument, the travel multiplier mechanism comprising:

a substantially cylindrical wall having a longitudinal length and a central axis extending along the longitudinal length, and having opposing slots formed therein;

a writing tip disposed at a lower portion of the cylindrical wall and on the central axis;

a push button member disposed at an upper portion of the cylindrical wall that is opposite the lower portion, the central axis passing through the push button member, the push button member partially disposed within the substantially cylindrical wall and movable along the central axis over a first distance between an extended position and a retracted position; and a sliding and pivoting cam member that is pivotally engaged within the opposing slots and that includes a tip;

wherein the sliding and pivoting cam member and the opposing slots are configured to constrain the motion of the sliding and pivoting cam member as the push button member is moved from the extended position to the retracted position, such that the tip of the sliding and pivoting cam member travels a second distance along the central axis that exceeds the first distance of travel of the push button member between the retracted position and the extended position.

9. The travel multiplier mechanism of claim 8, further including a sliding piston member that is disposed within the substantially cylindrical wall, and that abuts the sliding and pivoting cam member.

10. The travel multiplier mechanism of claim 9, wherein the sliding piston member includes a protuberance which serves to constrain the motion of the sliding and pivoting cam member as the push button member is moved from the extended position to the retracted position.

11. The travel multiplier mechanism of claim 8, wherein the slots are disposed at a diagonal orientation with respect to the primary axis.

12. The writing instrument of claim 8, wherein the cam member pivots from a substantially horizontal orientation to a substantially vertical orientation in response to motion of the push button member from the extended position to the retracted position.

13. The writing instrument of claim 8, wherein the sliding and pivoting cam member includes a pivot axis about which it rotates, the pivot axis translating from a first position to a second position along the central axis of the writing instrument in response to motion of the push button member from the extended position to the retracted position.

14. A writing instrument comprising:

a barrel having a longitudinal length and a central axis extending along the longitudinal length;

a writing tip disposed at a lower portion of the barrel and on the central axis;

a push button member disposed at an upper portion of the barrel that is opposite the lower portion, the central axis passing through the push button member, the push button member being movable along the central axis between an extended position and a retracted position;

a cam member that pivots about a pivot axis from a substantially horizontal orientation to a substantially vertical orientation in response to motion of the push button member from the extended position to the retracted position, and that has a tip; and a sliding piston member disposed on the central axis and engaged by the tip of the cam member, the sliding piston member configured such that a distance of travel of the sliding piston member along the central axis exceeds a distance traveled by the push button member when the push button member is moved between the extended position and the retracted position.

15. The writing instrument of claim 14, wherein the pivot axis of the cam member translates from a first position to a second position along the central axis of the writing instrument in response to motion of the push button member from the extended position to the retracted position.

16. The writing instrument of claim 14, wherein the writing instrument further comprises a wall having opposing slots formed therein, and the cam member is pivotally engaged within the opposing slots, wherein the slots are disposed at a diagonal orientation with respect to the central axis.

* * * * *